US009322371B2

(12) United States Patent
Sarder et al.

(10) Patent No.: US 9,322,371 B2
(45) Date of Patent: Apr. 26, 2016

(54) SLIDE-IN MOUNTABLE FUEL PUMP ASSEMBLY

(71) Applicant: Champion Engine Technology, LLC, Sussex, WI (US)

(72) Inventors: Mark J. Sarder, Waukesha, WI (US); James J. Dehn, Brookfield, WI (US)

(73) Assignee: Champion Engine Technology, LLC, Sussex, WI (US)

( * ) Notice: Subject to any disclaimer, the term of this patent is extended or adjusted under 35 U.S.C. 154(b) by 100 days.

(21) Appl. No.: 14/248,470

(22) Filed: Apr. 9, 2014

(65) Prior Publication Data

US 2015/0292452 A1 Oct. 15, 2015

(51) Int. Cl.

| | |
|---|---|
| ***F02M 37/04*** | (2006.01) |
| ***F02M 37/00*** | (2006.01) |
| ***F02M 37/14*** | (2006.01) |
| *F01P 5/02* | (2006.01) |
| *F02B 63/02* | (2006.01) |

(52) U.S. Cl.

CPC ..... *F02M 37/0011* (2013.01); *F02M 37/04* (2013.01); *F02M 37/14* (2013.01); *F01P 5/02* (2013.01); *F02B 63/02* (2013.01)

(58) Field of Classification Search

CPC ... F02M 37/0011; F02M 37/14; F02M 37/04; F02M 35/10216; F02M 59/44; F02M 59/48; F02M 2200/85; F02B 63/02; F02B 75/22

USPC ..... 123/195 A, 195 C, 198 C, 198 E, 509

See application file for complete search history.

(56) References Cited

U.S. PATENT DOCUMENTS 7,757,670 B2 7/2010 Yamada et al.
7,828,509 B2 * 11/2010 Morris ..... F02M 37/045 415/145

FOREIGN PATENT DOCUMENTS

CN 200920207140 7/2010

* cited by examiner

*Primary Examiner* — Grant Moubry

(74) *Attorney, Agent, or Firm* — Ziolkowski Patent Solutions Group, SC

(57) ABSTRACT

A system and method for engaging a slide-in mountable fuel pump assembly with a fan cover of an internal combustion engine is disclosed. The fuel pump assembly includes a fuel pump configured to pump fuel from a fuel source to the engine and a mounting bracket affixed to or formed integrally with the fuel pump and configured to slidingly engage a fan cover of the engine so as to enable selective mounting and removal of the fuel pump assembly to and from the fan cover. The mounting bracket further includes a main plate affixed to or formed integrally with the fuel pump and a track formed on each of opposing sides of the main plate, with the track configured to slidingly engage a mating feature formed on the fan cover of the engine so as to selectively mount the fuel pump assembly to the fan cover.

21 Claims, 7 Drawing Sheets

SLIDE-IN MOUNTABLE FUEL PUMP ASSEMBLY

BACKGROUND OF THE INVENTION

Embodiments of the invention relate generally to internal combustion engines and, more particularly, to a slide-in mountable fuel pump that is engaged with a fan cover of the engine to enable easy attaching and detaching of the fuel pump.

General purpose internal combustion engines used as prime movers in power generators, lawn mowers, power washers and various other applications often use a fuel pumps and associated charge former (e.g., carburetor or fuel injector) to supply fuel to the engine. The fuel pump is installed or interposed in a fuel supply pipe connecting the fuel tank with the charge former, and the fuel pump is typically mounted on the engine in a semi-permanent fashion. That is, the fuel pump is typically affixed to/within the engine via the use of screws or other hardware that require the use of tools to affix and remove the fuel pump.

The semi-permanent mounting of the fuel pump with the engine secures the pump properly for operation, and prevents displacement thereof—as might occur due to movement of the engine and/or standard operation of the engine. However, in a situation where a fuel pump breakdown occurs and a timely removal and replacement of the pump is required, such semi-permanent mounting of the fuel pump can lead to a lengthy removal and replacement process. Additionally, if the fuel pump breakdown occurs in a setting where tools necessary for removal are not readily available, then removal and replacement of the fuel pump may not be easily achievable.

Therefore, it would be desirable to provide an internal combustion engine having a quick disconnect fuel pump. It would further be desirable for such a quick disconnect fuel pump to be removable and mountable on the engine without the use of semi-permanent fasteners or tools.

BRIEF DESCRIPTION OF THE INVENTION

In accordance with one aspect of the invention, a fuel pump assembly for use with an internal combustion engine includes a fuel pump configured to pump fuel from a fuel source to the internal combustion engine and a mounting bracket affixed to or formed integrally with the fuel pump and configured to slidingly engage a fan cover of the engine so as to enable selective mounting and removal of the fuel pump assembly to and from the fan cover, wherein the mounting bracket further includes a main plate affixed to or formed integrally with the fuel pump and a track formed on each of opposing sides of the main plate, the track configured to slidingly engage a mating feature formed on the fan cover of the internal combustion engine so as to selectively mount the fuel pump assembly to the fan cover.

In accordance with another aspect of the invention, an internal combustion engine includes a carburetor configured to regulate an amount of fuel and air admitted into combustion cylinders of the internal combustion engine, a fuel pump assembly configured to pump fuel from a fuel source to the carburetor, a cooling fan configured to cool the internal combustion engine by drawing in air and blowing it onto the internal combustion engine, and a fan cover positioned to enclose the cooling fan and having an outer surface and an inner surface, the inner surface of the fan cover including a mounting feature configured to slidingly engage the fuel pump assembly so as to enable selective mounting and removal of the fuel pump assembly to and from the fan cover.

In accordance with yet another aspect of the invention, a method for securing a fuel pump assembly in an internal combustion engine includes providing an internal combustion engine that includes a cooling fan configured to provide cooling during operation thereof and a fan cover positioned over the cooling fan, the fan cover having an inner surface that includes a mounting channel formed thereon. The method also includes providing a fuel pump configured to pump fuel from a fuel source to the internal combustion engine, the fuel pump comprising a housing having a pair of protrusions formed thereon each including an opening formed therethrough that is configured to receive a fastener. The method further includes affixing a mounting bracket to the fuel pump by threading fasteners through the openings in the pair of protrusions such that the fasteners engage the mounting bracket, with the fuel pump and mounting collectively forming a fuel pump assembly. The method still further includes sliding the mounting bracket into the mounting channel formed on the inner surface of the fan cover, such that the fuel pump assembly is mounted on the fan cover of the engine free of the use of any fasteners.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION

Embodiments of the invention are directed to a fuel pump assembly mounted to an internal combustion engine, with the fuel pump assembly being constructed as a quick disconnect fuel pump that is removable and mountable on the engine without the use of semi-permanent fasteners or tools. It is recognized that the fuel pump assembly may be incorporated into an internal combustion engine used as a prime mover in any of a number of various applications, including but not limited to engines in power generators, lawn mowers, and power washers, for example. While an embodiment of the invention is described below as being incorporated into a power generator, it is to be understood that such a disclosure is not meant to be limiting, and that the scope of the invention is meant to encompass any suitable application in which a general purpose internal combustion engine can benefit from incorporation of a fuel pump assembly as shown and described herein.

Figure 1:
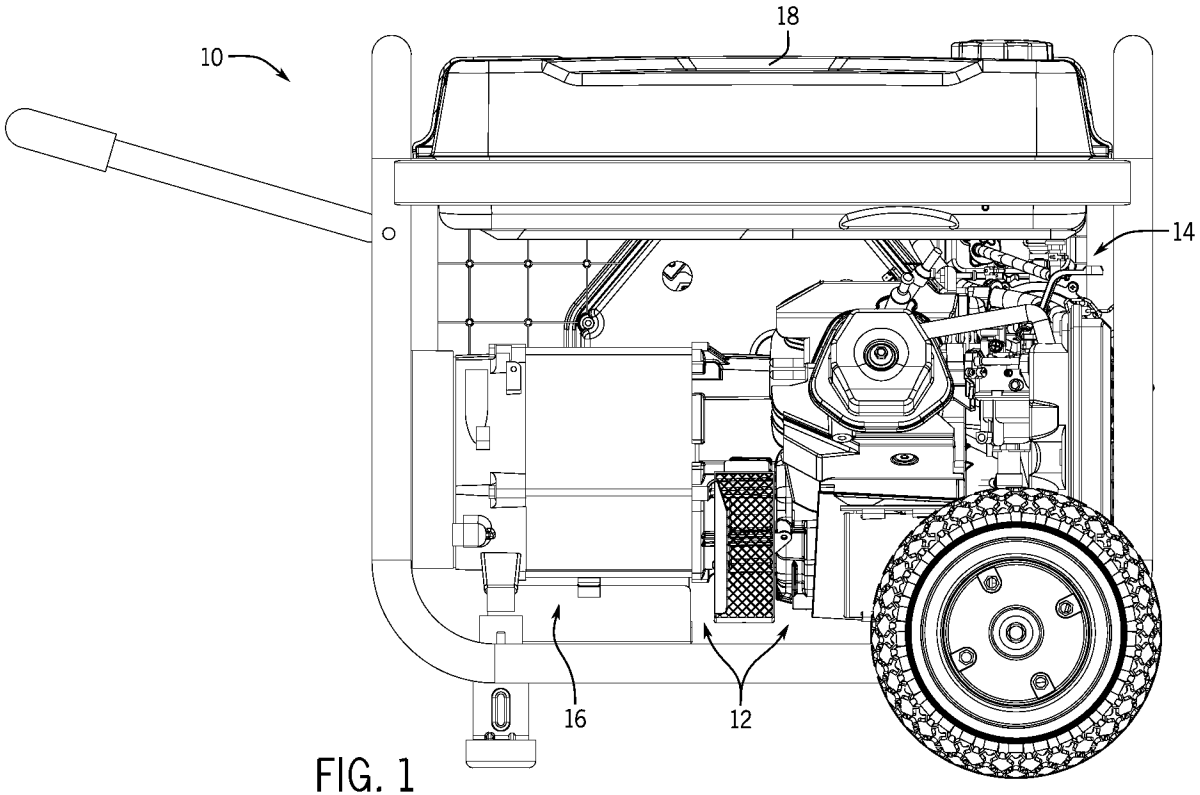
FIG. 1 is a view of a generator useable with embodiments of the invention.

Referring first to FIG. 1, a generator 10 is illustrated as one example of a device that can benefit from incorporation of embodiments of the invention. In general, generator 10 includes an engine assembly 12 that includes an internal combustible engine 14 operatively connected to an alternator 16 in a conventional manner, such as through a common shaft. A fuel source 18 is connected to the internal combustible engine 14 for supplying fuel thereto, with the fuel used by the internal combustible engine 14 being any of a number of suitable fuels, including gasoline for example. In operation, a fuel and air mixture is provided to the internal combustible engine 14 and is ignited so as to cause the engine to generate mechanical that drives the alternator 16. As is conventional, the driven alternator 16 generates electrical power.

Figure 2:
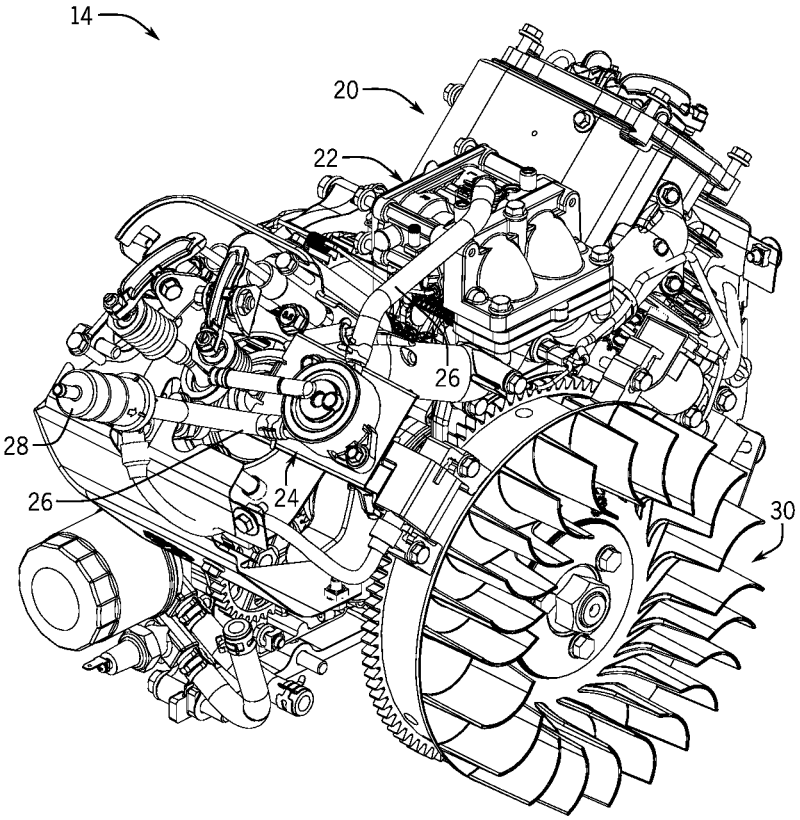
FIGS. 2 and 3 are views of an internal combustion engine, with and without a fan cover and other associated covers included, according to an embodiment of the invention.
Figure 3:
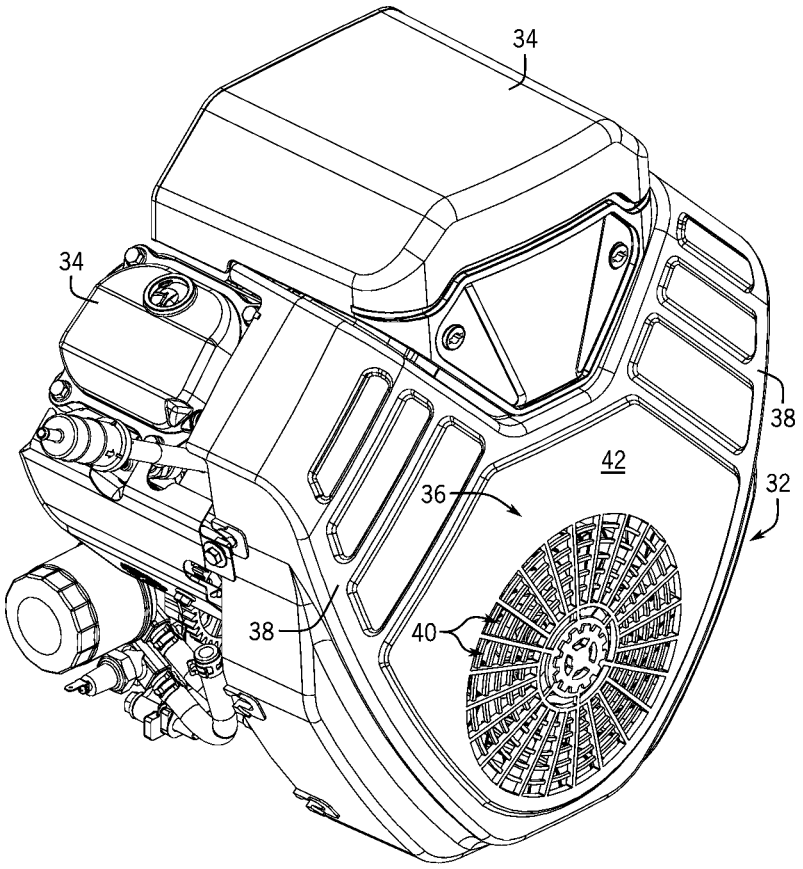

A more detailed view of an internal combustible engine 14 that might be incorporated into generator 10 (or alternatively into a lawn mower, power washer, or other similar suitable device/system) is shown in FIGS. 2 and 3, according to an embodiment of the invention. As best seen in FIG. 2—with covers and other components of the engine removed for purposes of clarity—the internal combustible engine 14 includes a collection of pistons that are slideably received within corresponding cylinders thereof, collectively indicated as 20, with each cylinder further including an intake valve (not shown) for admitting a fuel-air mixture and an exhaust valve (not shown) for venting exhaust gases following combustion. The fuel-air mixture is provided by a carburetor 22 that includes a movable throttle, with a position of the throttle regulating the amount of fuel and air admitted into the cylinders and thus the speed and power developed by the engine 14 when the air-fuel mixture is ignited to generate reciprocal movement of the pistons.

For providing fuel to the carburetor 22, a fuel pump assembly 24 is provided that is positioned on a fuel path 26 between the fuel source 18 (FIG. 1) and carburetor 22 and downstream of a fuel filter 28 configured to remove any impurities from the fuel prior to reaching the fuel pump assembly. The fuel pump assembly 24 functions to pump fuel from fuel source 18 to the carburetor 22 so as to enable a proper mixing of fuel and air for combustion in the engine cylinders. According to embodiments of the present invention, the fuel pump assembly 24 is configured as a quick disconnect fuel pump assembly 24 that is mountable with/to the engine 14—and removable from the engine—in a quick and easy fashion without the use of semi-permanent fasteners or tools, as will be described in greater detail below.

Also included in internal combustible engine 14 is a cooling fan 30 that is provided for cooling the engine 10. The cooling fan 30 operates to draw-in air and blow it onto the engine 14 during operation thereof in a known fashion. As shown in FIG. 3, the cooling fan 30 is enclosed by a fan cover 32—with additional covers, generally indicated as 34, also being provided to cover other components of the internal combustion engine. The fan cover 32 is shaped to match a profile of the engine 14 and as such has a generally V-shaped profile or configuration. As a result, the fan cover 32 includes a center region 36 as well as a pair of outer regions 38 that extend outwardly from the center region 36 in a V-shaped arrangement. The center region 36 of the fan cover 32 is positioned near the cooling fan 30 of the engine 14 and includes an arrangement of air intake holes 40 formed therein through which a flow of cooling air is drawn in to cool the engine 14 during operation. The outer regions 38 of the fan cover 32 extending upwardly and outwardly from the center region 36.

Figure 4:
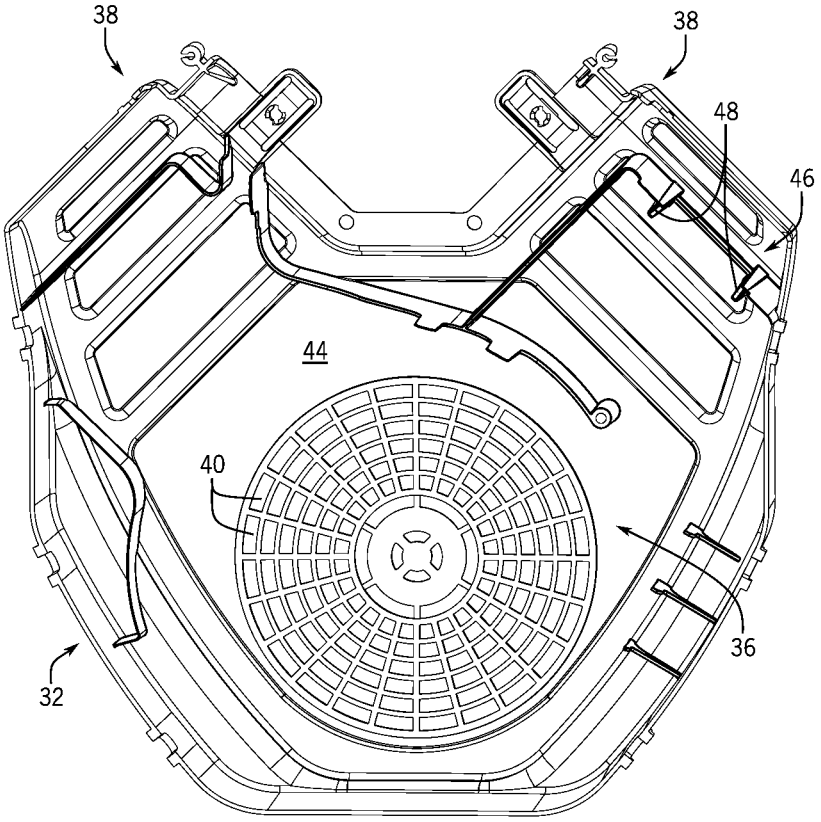
FIG. 4 is a rear view of a fan cover included in the internal combustion engine of FIGS. 2 and 3, according to an embodiment of the invention.

In general, the fan cover 32 is constructed with an outer surface 42 and inner surface 44 that provide desirable functional and aesthetic characteristics to the engine, with the inner surface 44 being constructed to enable positioning of the fan cover 32 over the cooling fan and other components of the engine. Additionally, according to embodiments of the invention, the inner surface 44 of the fan cover 32 is further constructed so as to enable mounting of the fuel pump assembly 24 thereto. The inner surface 44 of the fan cover 32 is illustrated in FIG. 4 and, as shown therein, includes a mating feature 46 formed into the inner surface 44 that enables mounting of the fuel pump assembly 24 to the fan cover 32. The mating feature 46 is formed in one of the outer regions 38 of the fan cover 32, such that mounting of the fuel pump assembly 24 to the inner surface 44 of the fan cover 32 does not interfere with positioning of the fan cover 32 over the cooling fan 30 of the engine 14.

According to an exemplary embodiment of the invention, the mating feature 46 is in the form of a pair of channels 48 that are formed on the inner surface 44 of the fan cover 32, with the channels 48 configured to receive features of the fuel pump assembly 24 therein in a sliding engagement so as to secure the fuel pump assembly 24 to the fan cover 32. As the fan cover 32 is fabricated of a material such as resin or other polymer that may be manufactured via an injection molding process, for example, the channels 48 may be integrally formed into the inner surface 44 of the fan cover 32 rather than being a separately formed/attached component. While the mating feature 46 is described here above as being in the form of channels 48, it is recognized that the mating feature may have a different construction that would enable sliding or snapping engagement of the fuel pump assembly 24 to the fan cover 32, such that the fuel pump assembly 24 can be mounted to the fan cover 32 without the use of semi-permanent fasteners or tools (i.e., a quick disconnect fuel pump assembly).

Figure 5:
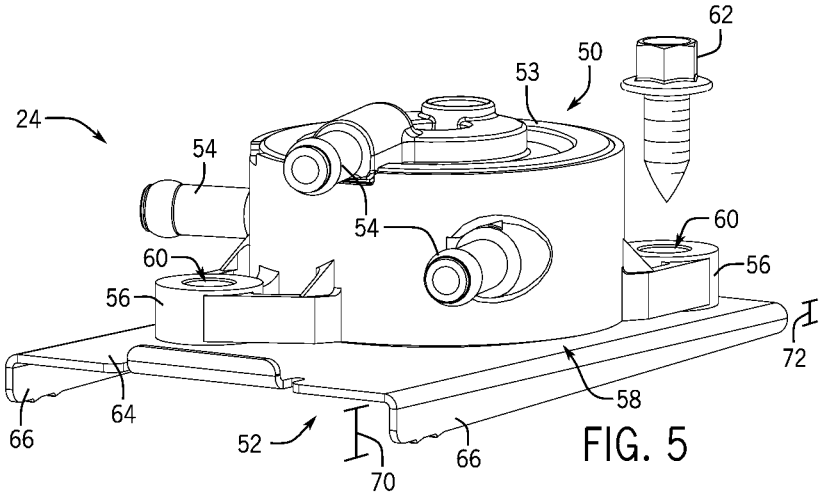
FIGS. 5 and 6 are views of a fuel pump assembly for use with the internal combustion engine of FIGS. 2 and 3, according to an embodiment of the invention.
Figure 6:
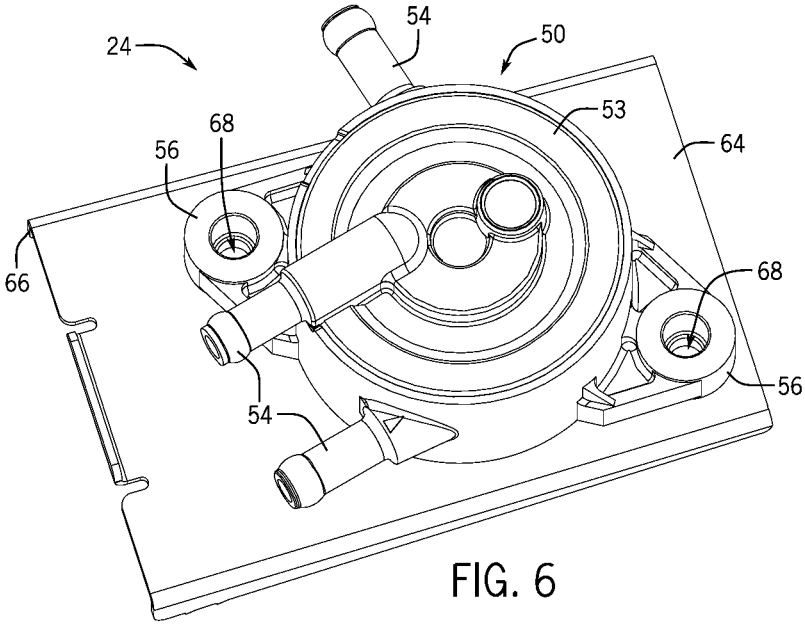
Figure 7:
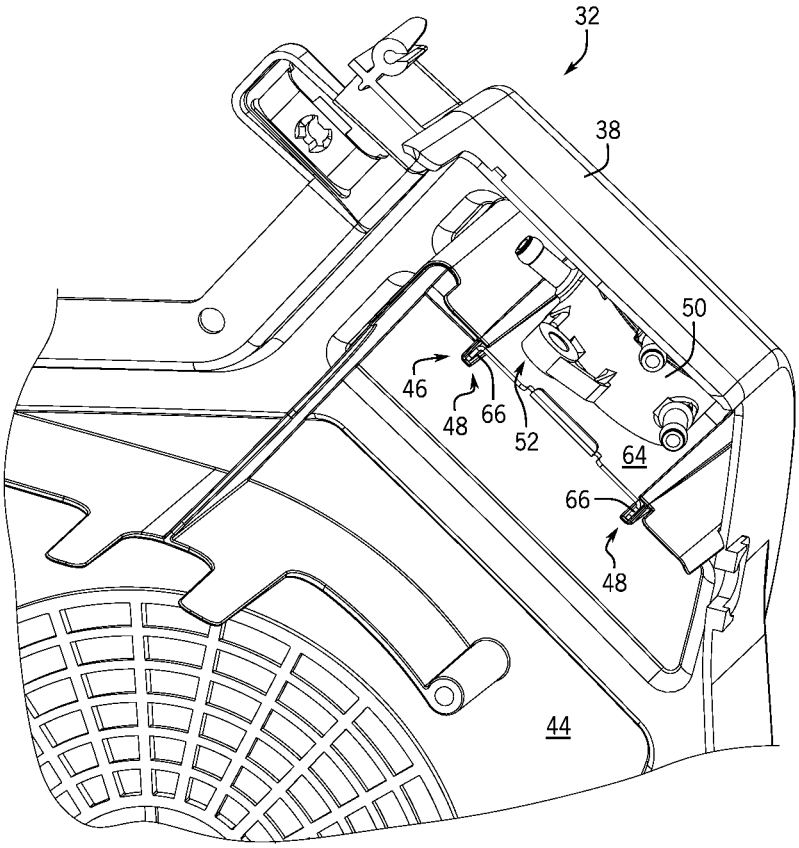
FIG. 7 is a view of the fuel pump assembly of FIGS. 5 and 6 mating with the fan cover of FIG. 4, according to an embodiment of the invention.

Referring now to FIGS. 5-7, detailed views of the fuel pump assembly 24—and of its mounting to fan cover 32—are shown according to an embodiment of the invention. As shown in FIGS. 5 and 6, fuel pump assembly 24 includes two separate components in the form of a fuel pump 50 and a mounting bracket 52. The fuel pump 50 is a pump having a known construction and functionality and generally includes a housing 53 enclosing a pumping mechanism (not shown) and a plurality of input and output attachments, generally indicated as 54, for connecting the fuel pump 50 to a fuel path 26 of the engine 14, such that the fuel pump 50 can receive fuel from the fuel source 18 (FIG. 1) and pump the fuel to the carburetor 22. According to one embodiment of the invention, the housing 53 of fuel pump 50 includes a pair of protrusions or flanges 56 formed thereon that provide for affixing of the fuel pump 50 to the mounting bracket 52. The protrusions 56 are formed on the housing 53 so as to be positioned at a bottom portion thereof and thus form part of a back surface 58 of the fuel pump 50. Each of the protrusions 56 includes a threaded opening 60 formed therethrough that is configured to receive a fastener 62—such as a screw of a desired type and size—that provides for securing of the fuel pump 50 to the mounting bracket 52.

The mounting bracket 52 of fuel pump assembly 24 is formed to generally include what can be described as a "main plate" and a "track", indicated as 64, 66, respectively. The main plate 64 is a flat planar surface that provides a proper surface for securing of the fuel pump 50 to the mounting bracket 52 such that the back surface 58 of the fuel pump (and the protrusions 56 thereon) can be made flush with the main plate 64 of the mounting bracket 52. According to an exemplary embodiment of the invention, the main plate 64 is constructed to include a pair of openings 68 pre-formed therein, with the openings 68 having a spacing and locations corresponding to the locations of the protrusions 56 of the housing, such that the openings 60 in the protrusions 56 can be aligned with the openings 68 in the main plate 64 so as to enable fasteners 62 to be threaded through the protrusion openings 60 and down through the main plate openings 68. It is recognized, however, that other embodiments of the invention might incorporate a mounting bracket 52 having a main plate 64 that does not include openings pre-formed therein, and that self-tapping screws could be threaded down through the protrusion openings 60 and screw through the main plate 64 (i.e., forming openings) to affix the fuel pump 50 to the mounting bracket 52.

As indicated above, the mounting bracket 52 also includes a track 66 formed thereon, and this track 66 enables the fuel pump assembly 24 to be mounted on the fan cover 32. The track 66 is formed on each of opposing sides of the main plate 64 and is configured to engage the mating feature 46 formed on the fan cover 32, so as to provide for selective mounting and removal of the fuel pump assembly 24 to/from the fan cover 32. In accordance with an exemplary embodiment of the invention, the track 66 is constructed as flanges formed on opposing sides of the main plate 64, with the flanges 66 extending out orthogonally from the main plate 64. As shown in FIG. 5, the flanges 66 may be formed as tapered flanges having a first width (indicated as 70) at a first end of the main plate 64 that tapers down to a second width (indicated as 72) at a second end of the main plate 64. Alternatively, the flanges 66 may have a uniform width along a length of the main plate 64.

Referring now to FIG. 7, the mounting of the fuel pump assembly 24 to fan cover 32 is shown in greater detail. According to an exemplary embodiment, the fuel pump assembly 24 is mounted to the fan cover 32 by sliding the track/flanges 66 of the mounting bracket 52 into the mounting channels 48 formed on the inner surface 44 of the fan cover 32. The sliding engagement of the mounting bracket 52 into channels 48 thus secures the fuel pump assembly 24 to the fan cover 32 such that, upon reattachment of the fan cover 32 to the engine 14, any displacement of the fuel pump assembly 24 is prevented. In such a manner, the fuel pump assembly 24 is mounted on the fan cover 32 of the engine 14 free of the use of any separate fasteners, such that a quick-disconnect fuel pump assembly 24 is provided for the engine. In the event that a breakdown of the fuel pump 50 occurs, the fuel pump assembly 24 may be easily removed and replaced by sliding the fuel pump assembly 24 out from the fan cover 32, without any tools being required for performing such removal.

Figure 8:
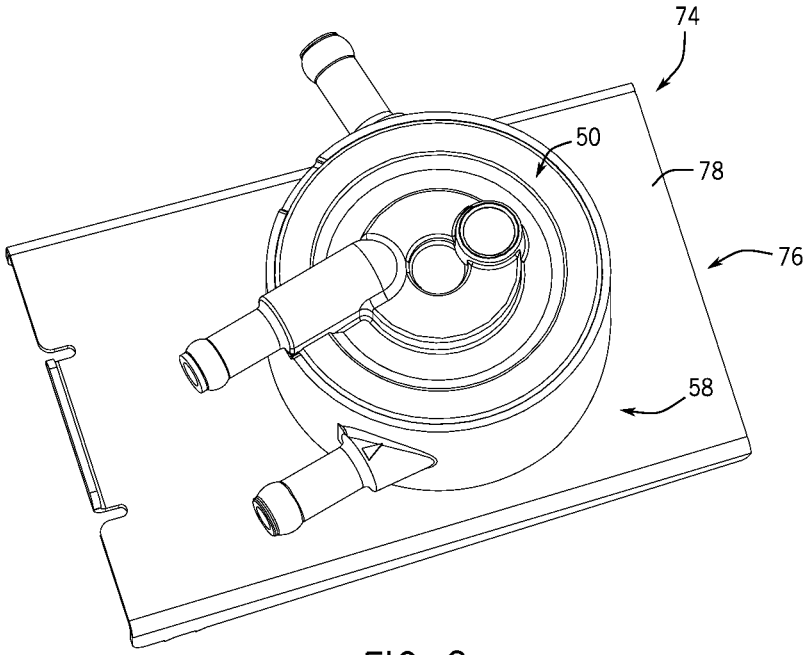
FIG. 8 is a view of a fuel pump assembly for use with the internal combustion engine of FIGS. 2 and 3, according to an embodiment of the invention.

While the fuel pump assembly 24 is shown and described in FIGS. 5 and 6 as including a mounting bracket 52 that is separate from fuel pump 50 and that is secured thereto by way of fasteners 62 that extend through openings 60 in the protrusions 56 and openings 68 in the main plate 64 of the mounting bracket 52, it is recognized that alternative constructions of the fuel pump assembly 24 are also envisioned. For example, as shown in FIG. 8, a fuel pump assembly 74 may be provided having a mounting bracket 76 formed integrally with the fuel pump 50. More specifically, the main plate 78 of the mounting bracket 76 is molded into the bottom portion of the fuel pump 50 (i.e., molded with the back surface 58 of fuel pump 50). In such an embodiment, it is recognized that the protrusions 56 of the fuel pump 50 shown in FIGS. 5 and 6 are not necessary for securing the fuel pump 50 to the mounting bracket 76—as no fasteners are needed—and may thus be removed.

Beneficially, embodiments of the invention thus provide a quick disconnect fuel pump for use in a general purpose internal combustion engine such as might be found in an electrical generator, lawn mower, or power washer, for example. The quick disconnect fuel pump in mounted to the fan cover of the engine via a sliding engagement with channels formed in the fan cover, such that the fuel pump is removable and mountable on the engine without the use of semi-permanent fasteners or tools.

Therefore, according to one embodiment of the invention, a fuel pump assembly for use with an internal combustion engine includes a fuel pump configured to pump fuel from a fuel source to the internal combustion engine and a mounting bracket affixed to or formed integrally with the fuel pump and configured to slidingly engage a fan cover of the engine so as to enable selective mounting and removal of the fuel pump assembly to and from the fan cover, wherein the mounting bracket further includes a main plate affixed to or formed integrally with the fuel pump and a track formed on each of opposing sides of the main plate, the track configured to slidingly engage a mating feature formed on the fan cover of the internal combustion engine so as to selectively mount the fuel pump assembly to the fan cover.

According to another embodiment of the invention, an internal combustion engine includes a carburetor configured to regulate an amount of fuel and air admitted into combustion cylinders of the internal combustion engine, a fuel pump assembly configured to pump fuel from a fuel source to the carburetor, a cooling fan configured to cool the internal combustion engine by drawing in air and blowing it onto the internal combustion engine, and a fan cover positioned to enclose the cooling fan and having an outer surface and an inner surface, the inner surface of the fan cover including a mounting feature configured to slidingly engage the fuel pump assembly so as to enable selective mounting and removal of the fuel pump assembly to and from the fan cover.

According to yet another embodiment of the invention, a method for securing a fuel pump assembly in an internal combustion engine includes providing an internal combustion engine that includes a cooling fan configured to provide cooling during operation thereof and a fan cover positioned over the cooling fan, the fan cover having an inner surface that includes a mounting channel formed thereon. The method also includes providing a fuel pump configured to pump fuel from a fuel source to the internal combustion engine, the fuel pump comprising a housing having a pair of protrusions formed thereon each including an opening formed therethrough that is configured to receive a fastener. The method further includes affixing a mounting bracket to the fuel pump by threading fasteners through the openings in the pair of protrusions such that the fasteners engage the mounting bracket, with the fuel pump and mounting collectively forming a fuel pump assembly. The method still further includes sliding the mounting bracket into the mounting channel formed on the inner surface of the fan cover, such that the fuel pump assembly is mounted on the fan cover of the engine free of the use of any fasteners.

While the invention has been described in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A fuel pump assembly for use with an internal combustion engine, the fuel pump assembly comprising:

a fuel pump configured to pump fuel from a fuel source to the internal combustion engine; and a mounting bracket affixed to or formed integrally with the fuel pump and configured to slidingly engage a fan cover of the engine so as to enable selective mounting and removal of the fuel pump assembly to and from the fan cover, wherein the mounting bracket comprises:

a main plate affixed to or formed integrally with the fuel pump; and a track formed on each of opposing sides of the main plate, the track configured to slidingly engage a mating feature formed on the fan cover of the internal combustion engine so as to selectively mount the fuel pump assembly to the fan cover.

2. The fuel pump assembly of claim 1 wherein the fuel pump comprises a housing having a pair of flanges formed thereon, with each of the pair of flanges including an opening formed therethrough to receive a fastener, and wherein the main plate is affixed to the fuel pump by way of fasteners received through the openings in the pair of flanges.

3. The fuel pump assembly of claim 2 wherein the pair of flanges of the housing are formed on the housing so as to form part of a back surface of the fuel pump.

4. The fuel pump assembly of claim 3 wherein the fuel pump is affixed to the mounting bracket such that the back surface of the fuel pump is flush with the main plate of the mounting bracket.

5. The fuel pump assembly of claim 2 wherein the main plate of the mounting bracket includes openings formed therein at locations corresponding to locations of the pair of flanges of the housing, such that fasteners can be positioned through the openings in the pair of flanges and the openings in the main plate to affix the fuel pump to the main plate.

6. The fuel pump assembly of claim 2 wherein the fasteners comprise self-tapping sheet metal screws configured to form holes through the main plate when threaded through the openings in the pair of flanges of the housing, so as to affix the main plate to the fuel pump.

7. The fuel pump assembly of claim 1 wherein the main plate of the mounting bracket is formed integrally with the fuel pump.

8. The fuel pump assembly of claim 1 wherein the track comprises a flange formed on each of opposing sides of the main plate, the flanges extending out orthogonally from the main plate.

9. The fuel pump assembly of claim 8 wherein the flanges comprise tapered flanges having a first width at a first end of the main plate that tapers down to a second width that is less than the first width at a second end of the main plate.

10. The fuel pump assembly of claim 8 wherein the flanges are received in channels formed on an inner surface of the fan cover, with the flanges slidingly engaging the channels such that the fuel pump assembly is selectively mountable to the fan cover.

11. An internal combustion engine, the internal combustion engine comprising:

a carburetor configured to regulate an amount of fuel and air admitted into combustion cylinders of the internal combustion engine;

a fuel pump assembly configured to pump fuel from a fuel source to the carburetor;

a cooling fan configured to cool the internal combustion engine by drawing in air and blowing it onto the internal combustion engine; and a fan cover positioned to enclose the cooling fan and having an outer surface and an inner surface, the inner surface of the fan cover including a mounting feature configured to slidingly engage the fuel pump assembly so as to enable selective mounting and removal of the fuel pump assembly to and from the fan cover.

12. The internal combustion engine of claim 11 wherein the fuel pump assembly comprises:

a fuel pump configured to pump fuel from the fuel source to the internal combustion engine; and a mounting bracket affixed to or formed integrally with the fuel pump and configured to slidingly engage the mounting feature on the fan cover, the mounting bracket including:

a main plate affixable to or formed integrally with the fuel pump; and a pair of flanges formed on opposing sides of the main plate that are configured to slidingly engage the mating feature on the fan cover.

13. The internal combustion engine of claim 12 wherein the flanges comprise tapered flanges having a first width at a first end of the main plate that tapers down to a second width that is less than the first width at a second end of the main plate.

14. The internal combustion engine of claim 12 wherein the mating feature on the fan cover comprises channels formed on the inner surface of the fan cover, with the pair of flanges slidingly engaging the channels such that the fuel pump assembly is selectively mountable to the fan cover.

15. The internal combustion engine of claim 12 wherein the fuel pump includes a housing having a pair of protrusions formed therein that each include an opening formed therein to receive a fastener, and wherein the main plate is affixed to the fuel pump by way of fasteners received through the openings in the pair of protrusions.

16. The internal combustion engine of claim 15 wherein the main plate includes openings formed therein at locations corresponding to locations of the openings formed in the pair of protrusions, such that fasteners can be positioned through the openings in the pair of protrusions and the openings in the main plate to secure the fuel pump to the mounting bracket.

17. The internal combustion engine of claim 15 wherein the fasteners comprise self-tapping sheet metal screws configured to form holes through the main plate when threaded through the openings in the pair of protrusions, so as to secure the fuel pump to the mounting bracket.

18. The internal combustion engine of claim 11 wherein the fan cover comprises a V-shaped cover generally matching a configuration of the internal combustion engine, the V-shaped cover comprising:

a center region having a plurality of air intake holes through which a flow of cooling air is drawn in; and a pair of outer regions extending outwardly from the center region in a V-shaped arrangement;

wherein one of the pair of outer regions includes the mounting feature formed on the inner surface thereof.

19. The internal combustion engine of claim 11 wherein the fuel pump assembly comprises a quick-disconnect fuel pump assembly that is mounted to the fan cover without using separate fasteners.

20. A method for securing a fuel pump assembly in an internal combustion engine, the method comprising:

providing the internal combustion engine with a cooling fan configured to provide cooling during operation thereof and a fan cover positioned over the cooling fan, the fan cover having an inner surface that includes a mounting channel formed thereon;

providing a fuel pump configured to pump fuel from a fuel source to the internal combustion engine, the fuel pump comprising a housing having a pair of protrusions formed thereon each including an opening formed therethrough that is configured to receive a fastener;

affixing a mounting bracket to the fuel pump by threading fasteners through the openings in the pair of protrusions such that the fasteners engage the mounting bracket, with the fuel pump and mounting collectively forming the fuel pump assembly; and sliding the mounting bracket into the mounting channel formed on the inner surface of the fan cover, such that the fuel pump assembly is mounted on the fan cover of the engine free of using any fasteners.

21. The method of claim 20 wherein the mounting bracket comprises a pair of flanges formed on opposing sides thereof, and wherein sliding the mounting bracket into the mounting channel comprises slidingly engaging the pair of flanges of the mounting bracket with the mounting channel of the fan cover.

* * * * *